US009581100B2

(12) United States Patent
Gilbert et al.

(10) Patent No.: US 9,581,100 B2
(45) Date of Patent: Feb. 28, 2017

(54) VEHICLE TORQUE COMPENSATION SYSTEM

(71) Applicant: GM GLOBAL TECHNOLOGY OPERATIONS LLC, Detroit, MI (US)

(72) Inventors: Marcus S. Gilbert, Grass Lake, MI (US); David S. Mathews, Howell, MI (US); Keith M. Lindsey, Jr., Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 277 days.

(21) Appl. No.: 14/300,827

(22) Filed: Jun. 10, 2014

(65) Prior Publication Data

US 2015/0354486 A1 Dec. 10, 2015

(51) Int. Cl.

| | |
|---|---|
| ***F02D 41/00*** | (2006.01) |
| ***F02D 41/04*** | (2006.01) |
| ***F02D 41/14*** | (2006.01) |
| *F02D 41/22* | (2006.01) |

(52) U.S. Cl.

CPC ..... *F02D 41/04* (2013.01); *F02D 41/0085* (2013.01); *F02D 41/045* (2013.01); *F02D 41/1498* (2013.01); *F02D 41/0097* (2013.01); *F02D 41/22* (2013.01); *F02D 2200/04* (2013.01); *F02D 2200/0614* (2013.01); *F02D 2200/101* (2013.01); *F02D 2200/1004* (2013.01); *F02D 2200/1015* (2013.01); *F02D 2250/18* (2013.01)

(58) Field of Classification Search

CPC ..... F02D 41/0085; F02D 41/1498; F02D 2200/101; F02D 2200/1004; F02D 2200/1015

USPC ..... 123/406.14, 406.26, 406.27, 436, 673

See application file for complete search history.

(56) References Cited

U.S. PATENT DOCUMENTS

| | | | | |
|---|---|---|---|---|
| 2011/0253100 | A1* | 10/2011 | Kaiser | F02D 41/0085 123/406.24 |
| 2012/0290191 | A1* | 11/2012 | Kobayashi | F02D 41/0085 701/102 |
| 2012/0310505 | A1* | 12/2012 | Morgan | F02D 35/024 701/102 |
| 2013/0118243 | A1* | 5/2013 | Jessen | F02D 41/0085 73/114.45 |
| 2015/0149063 | A1* | 5/2015 | Shah | F02D 41/0085 701/104 |

* cited by examiner

*Primary Examiner* — Erick Solis

(74) *Attorney, Agent, or Firm* — Cantor Colburn LLP

(57) ABSTRACT

A control system configured to control an internal combustion engine includes a crankshaft and an engine speed sensor. The crankshaft is rotated in response to combusting a mixture of air and fuel delivered to at least one cylinder included in the internal combustion engine. The engine output speed sensor is configured to output an engine output speed signal indicating a rotational speed of the crankshaft. An engine control module controls an amount of air and fuel delivered to the at least one cylinder and estimates a torque output based on the amount of air and fuel. A torque compensation module is configured to determine at least one weak cylinder based on the engine output speed signal. The torque compensation module is further configured to determine a torque compensation value that adjusts the estimated torque output based on the weak cylinder.

20 Claims, 2 Drawing Sheets

VEHICLE TORQUE COMPENSATION SYSTEM

FIELD OF THE INVENTION

The subject invention relates to vehicle powertrain systems, and more particularly, to an engine control system based on torque control.

BACKGROUND

A vehicle includes an engine that generates torque. The engine transfers the torque output to a transmission via a crankshaft. The vehicle moves when torque output is transferred to one or more wheels of the vehicle. A crankshaft sensor or engine output speed (EOS) sensor generates a signal based upon the rotation of the crankshaft.

On occasion the engine may misfire due to various reasons such as, for example, improper delivery of fuel and/or air. Conventional engine control systems utilize the torque output generated by the engine to detect an engine misfire. In some instances, an engine misfire causes one or more individual cylinders to output an unequal amount of drive torque. That is to say, the strength of some cylinders can be weaker than others, resulting in a torque imbalance across the cylinders. Consequently, an engine misfire may be misdiagnosed.

SUMMARY OF THE INVENTION

In one exemplary embodiment, a control system configured to control an internal combustion engine includes a crankshaft and an engine speed sensor. The crankshaft is rotated in response to combusting a mixture of air and fuel delivered to at least one cylinder included in the internal combustion engine. The engine speed sensor is configured to output an engine output speed signal indicating a rotational speed of the crankshaft. An engine control module controls an amount of air and fuel delivered to a cylinder and estimates a torque output based on the amount of air and fuel. A torque compensation module is configured to determine at least one weak cylinder based on the engine output speed signal. The torque compensation module is further configured to determine a torque compensation value that adjusts the estimated torque output based on the weak cylinder.

In another exemplary, an electronic control module configured to adjust an estimated torque output value to compensate for a misfire of at least one cylinder included in an internal combustion engine comprises a cylinder performance module configured to determine a strong cylinder based on a first combustion force and a weak cylinder based on a second combustion force that is less than the first combustion force. A fuel calculation module is in electrical communication with the cylinder performance module. The fuel calculation module is configured to determine an amount of fuel delivered to the at least one weak cylinder. A fuel-to-torque conversion module is in electrical communication with the fuel calculation module. The fuel-to-torque conversion module is configured to convert the fuel delivered to the at least one weak cylinder into a torque loss value. A torque correction module is in electrical communication with the fuel-to-torque conversion module. The torque correction module is configured to generate an adjusted torque output value based on a difference between the estimated torque output value and the torque loss value.

In another exemplary embodiment, a method of controlling an internal combustion engine comprises combusting a mixture of air and fuel delivered to at least one cylinder included in the internal combustion engine to rotatably drive a crankshaft. The method further includes generating an engine output speed signal indicating a rotational speed of the crankshaft. The method further includes estimating a torque output of the internal combustion engine based on the amount of air and fuel delivered to the at least one cylinder. The method further includes determining at least one weak cylinder based on the engine output speed signal, and determining a torque compensation value that adjusts the estimated torque output based on the weak cylinder.

The above features of the invention are readily apparent from the following detailed description of the invention when taken in connection with the accompanying drawings.

BRIEF DESCRIPTION OF THE DRAWINGS

Other features and details appear, by way of example only, in the following detailed description of embodiments, the detailed description referring to the drawings in which.

DESCRIPTION OF THE EMBODIMENTS

Figure 1:
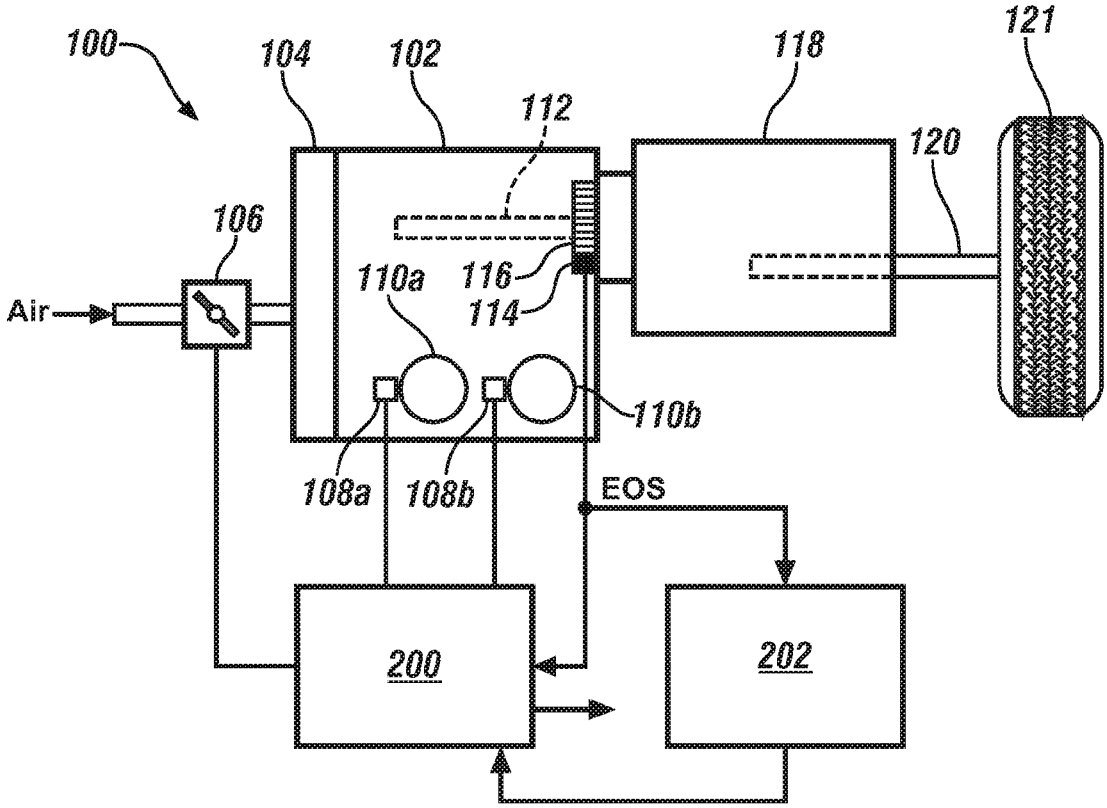
FIG. 1 is a functional block diagram illustrating a vehicle system according to an exemplary embodiment of the present disclosure.

The following description is merely exemplary in nature and is not intended to limit the present disclosure, its application or uses. It should be understood that throughout the drawings, corresponding reference numerals indicate like or corresponding parts and features.

At least one embodiment includes an engine control module configured to detect a misfire of one or more individual cylinders based on a misfire detection threshold. The misfire detection threshold may be determined by the control module based on a torque signal that is generated according to the rotation of the crankshaft. A torque compensation module is in electrical communication with the engine control module and is configured to determine a compensation value that dynamically adjusts an initial estimated torque output value determined by the engine control module. According to an embodiment, the compensation value is based on an amount of fuel loss resulting from a misfire on one or more cylinders, e.g., a weak cylinder. In this regard, the adjusted torque output value may compensate for a misfire of one or more individual cylinders and improve the accuracy of detecting an engine misfire event.

Referring now to FIG. 1, a functional block diagram of a vehicle system 100 is illustrated according to an exemplary embodiment. The vehicle system 100 includes an engine 102 configured to generate a rotational torque. For purposes of discussion only, the engine 102 will be discussed as a diesel-type internal combustion engine. It is appreciated, however, that vehicle system 100 may be utilized with other types of internal combustion engines including, but not limited to, spark-ignition (e.g., gasoline-type) internal combustion engine. One or more systems and/or actuators of the engine 102 may be controlled by an engine control module (ECM) 200 as described in greater detail below.

Air is drawn into the engine 102 through an intake manifold 104. The volume of air drawn into the engine 102 may be varied by a throttle valve 106. One or more fuel injectors 108 mix fuel with the air to form a combustible air/fuel mixture. According to an embodiment, the ECM 200 is configured to control opening of the throttle valve 106. It is appreciated, however, that individual actuator modules (e.g., a throttle actuator module and a fuel actuator module) may be provided to control the throttle valve 106 and the fuel injector 108, respectively.

The engine 102 includes one or more cylinders 110*a*, 110*b*, etc. Each cylinder 110*a*, 110*b*, etc. includes a piston (not shown) that is coupled to a crankshaft 112. Although the engine 102 is depicted as including only the cylinder 110*a*, 110*b*, etc., it is appreciated that the engine 102 may include more than one cylinder 110*a*, 110*b*, etc. Combustion of the air/fuel mixture may include four-strokes: an intake stroke, a compression stroke, a combustion (or expansion) stroke, and an exhaust stroke. During the intake stroke, the piston is lowered to a bottom most position, for example, and the air and fuel are introduced into the cylinder 110*a*, 110*b*, etc. The bottom most position may be referred to as a bottom dead center (BDC) position.

During the compression stroke, the crankshaft 112 drives the piston toward a top most position, for example, thereby compressing the air/fuel mixture within the cylinder 110*a*, 110*b*, etc. The top most position may be referred to as a top dead center (TDC) position. Combustion of the air/fuel mixture drives the piston toward the BDC position, thereby rotatably driving the crankshaft 112. This rotational force (i.e., torque) may be the compressive force that compresses the air/fuel mixture during the compression stroke of a next cylinder in a predetermined firing order of the cylinders 110*a*, 110*b*, etc. Exhaust gas resulting from the combustion of the air/fuel mixture is expelled from the cylinder 110*a*, 110*b*, etc. during the exhaust stroke.

An engine output speed (EOS) sensor 114 measures rotational speed of the crankshaft 112 and generates an EOS signal indicating the EOS. For example only, the EOS sensor 114 may include a variable reluctance (VR) sensor or another suitable type of EOS sensor 114. The gear 116 may include "N" number of teeth, and is configured to rotate with the crankshaft 112. The EOS sensor 114 generates a pulsed signal in response to detecting one or more of the teeth during rotation of the gear 116. The time period between each pulse (i.e., between each detected tooth) may determine the overall speed of the crankshaft 112.

Each pulse of the signal may correspond to an angular rotation of the crankshaft 112 by an amount equal to 360° divided by N teeth. For example only, the gear 116 may include 60 equally spaced teeth (i.e., n=60) and each pulse may correspond to 6° of rotation of the crankshaft 112. In various implementations, one or more of the N equally spaced teeth may be omitted. For example only, two of the N teeth may be omitted. The one or more teeth may be omitted, for example, as an indicator of one revolution of the crankshaft 112. The EOS sensor 114 may generate the EOS based on a time period between the pulses, i.e., between each sensed tooth. For example only, the EOS sensor 114 may generate the EOS based on a period that it takes the crankshaft 112 to rotate a predetermined angle (e.g., 90°) during the expansion stroke of the cylinder 110*a*, 110*b*, etc. The EOS may be utilized to determine additional dynamic events (i.e., disturbances) of the crankshaft 112 including, but not limited to, acceleration/deceleration and/or jerks, which in turn indicates a disturbance of one or more cylinders 110*a*, 110*b*, etc. For example, a disturbance of a cylinder 110*a*, 110*b*, etc. may be determined based on a first derivative of the EOS (e.g., speed) measured during the combustion stroke of the cylinder 110*a*, 110*b*, etc., a second derivative of the EOS measured during the combustion stroke of the cylinder 110*a*, 110*b*, etc., and a second derivative of the EOS measured during the combustion stroke of a next cylinder that immediately follows the cylinder 110*a*, 110*b*, etc. in the firing order. The first derivative of speed is acceleration/deceleration, and the second derivative of speed is jerk.

A misfire may occur within the cylinder 110*a*, 110*b*, etc. for a number of reasons, such as improper delivery of fuel and/or air. Since the misfire typically disturbs the movement of one or more cylinders 110*a*, 110*b*, etc., the misfire also may disturb the rotation of the crankshaft 112 which causes fluctuation in the EOS signal. In this manner, an acceleration, deceleration, and/or jerk of the cylinder 110*a*, 110*b*, etc. caused by a misfire may be determined based on a fluctuations of the EOS signal.

The engine 102 may transfer the torque output to a transmission 118 via the crankshaft 112 as understood by one of ordinary skill in the art. The transmission 118 may transfer torque to one or more wheels 121 via a transmission output shaft 120. In the case where the transmission 118 is an automatic-type transmission, the vehicle system 100 may include a torque transfer device, such as a torque converter, that transfers the output torque to the transmission 118.

The ECM 200 further controls the torque output by the engine 102 (i.e., torque provided by the crankshaft 112). The ECM 200 may control the torque output by the engine 102 by controlling one or more engine actuators. For example, the ECM 200 may output one or more control signals that control a respective actuator associated with the throttle valve 106 and/or a fuel injector 108. The control signal may, for example, control the opening area of the throttle valve 106, the amount of fuel provided by the fuel injector 108, and/or fueling rate of the cylinders 110*a*, 110*b*, etc., and/or the timing at which the fuel is compressed.

The ECM 200 is further configured to detect an engine misfire (e.g., a misfire of one or more individual cylinders 110*a*, 110*b*, etc., based on the torque output of the engine 102. According to an embodiment, an EOS look-up table (LUT) stored in the ECM 200 cross-references a list of stored torque values to a respective EOS threshold value. The ECM 200 compares the torque output to the torque values listed in the EOS LUT to determine a corresponding EOS threshold value. In this manner, the ECM 200 may determine that a misfire of one or more cylinders 110*a*, 110*b*, etc. has occurred when a measured EOS (i.e., the EOS signal output by the EOS sensor 114) exceeds the determined EOS threshold value.

In the event of an engine misfire, the ECM 200 may determine one or more weak, i.e., underperforming cylinders, and may divert a portion of the air and/or fuel intended for strong, i.e., satisfactory, performing cylinders to the weak cylinder. In this manner, the ECM 200 balances torque production of the engine 102 such that the cylinders 110*a*, 110*b*, etc. each produce approximately the same amount of torque. A conventional torque balancing system, however, assumes that each cylinder 110*a*, 110*b*, etc. continues producing approximately the same amount of torque during subsequent engine cycles. Consequently, an engine control module included in a conventional engine system is not provided with any feedback as to whether the diverted fuel prevents any torque loss.

While not shown in the exemplary embodiment of FIG. 1, the ECM 200 may also control other engine actuators. For example only, the ECM 200 may control a boost actuator module that controls boost provided by a boost device, an exhaust gas recirculation (EGR) actuator module that controls opening of an EGR valve, a phaser actuator module that controls intake and exhaust cam phaser positions, and/or other suitable engine actuators as understood by one of ordinary skill in the art.

The vehicle system 100 further includes a torque compensation module 202 in electrical communication with the EOS sensor 114 and the ECM 200. The torque compensation module 202 is configured to determine a compensation value that dynamically adjusts the estimated torque output to compensate for an engine misfire. The compensation value may include, for example, an amount of torque loss resulting from one or more weak (i.e., underperforming) cylinders 110*a*, 110*b*, etc. A weak cylinder may be caused by a cylinder misfire, for example. According to an embodiment, the compensation value is determined according to an amount of fuel loss resulting from a misfire of one or more cylinders 110*a*, 110*b*, etc. The adjusted torque output may then be used to determine the respective EOS threshold value from the EOS LUT, which in turn is used to determine an engine misfire as described in detail above.

Figure 2:
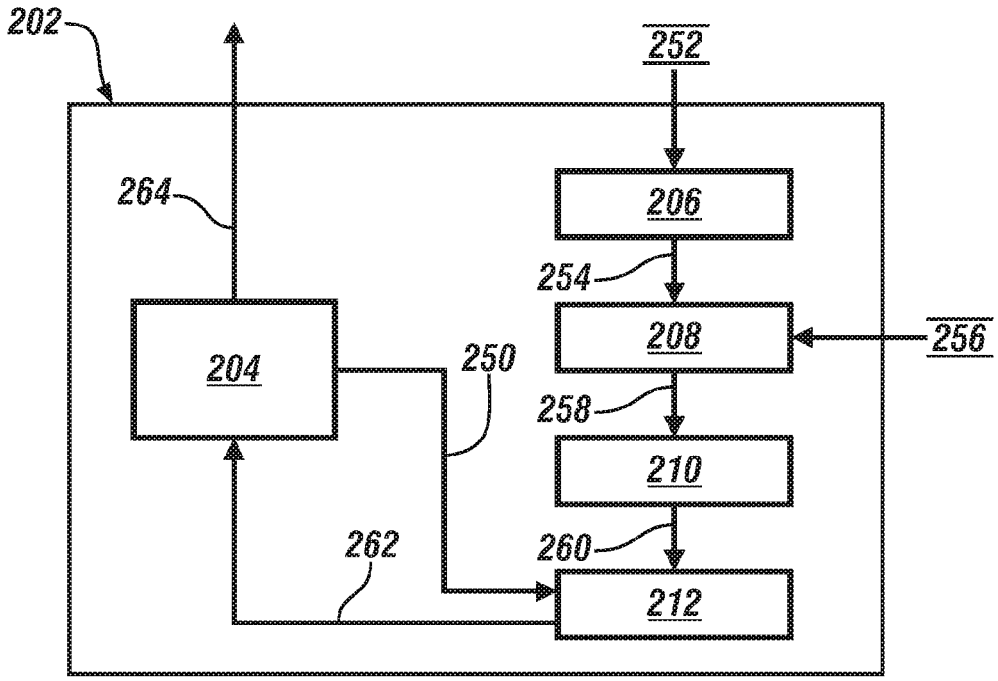
FIG. 2 is a functional block diagram illustrating an electronic torque compensation module according to an exemplary embodiment of the present disclosure.

Turning now to FIG. 2, a functional block diagram of an electronic torque compensation module 202 is illustrated according to an exemplary embodiment of the present disclosure. The torque compensation module 202 includes a torque balancing module 204, a cylinder performance module 206, a fuel calculation module 208, a fuel-to-torque conversion module 210, and a torque correction module 212.

The torque balancing module 204 may estimate the torque output that is generated based on the states of the engine actuators. Accordingly, the torque balancing module 204 may generate an estimated torque signal 250 indicating an initial estimated torque output of the engine 100. This estimated torque output may be used by the ECM 200 to perform closed-loop control of various engine air flow and fuel mixture parameters including, but not limited to, throttle area, manifold absolute pressure (MAP), fuel mass, and piston timing. For example, a torque (T) relationship may be defined as:

$$T=f(\mathrm{APC},\mathrm{AF},n) \tag{1}$$

In this relationship, the torque (T) is a function of air per cylinder (APC), air/fuel ratio (AF), and the number (n) of activated cylinders. Additional variables may also be accounted for as understood one of ordinary skill in the art. The torque relationship may be modeled by an equation and/or may be stored as a lookup table. Although the torque balancing module 204 is illustrated as being included in the torque compensation module, it is appreciated that the torque balancing module 204 may be implemented as an individual stand-alone module separate from the compensation module 202.

The cylinder performance module 206 may determine a strength, e.g., the output force, of one or more cylinders 110*a*, 110*b*, etc. According to an embodiment, the cylinder performance module 206 receives the EOS signal 252 from the EOS sensor 114 and determines the strength of a cylinder 110*a*, 110*b*, etc. based on an acceleration/deceleration and/or jerk of the crankshaft 112. As discussed above, the acceleration/deceleration is the first derivative of the EOS signal 252 and the jerk is the second derivative of the EOS signal 252. According to an embodiment, the cylinder performance module 206 may attribute a deceleration and/or jerk during an engine cycle to a weak or underperforming cylinder 110*a*, 110*b*, etc. For example, if the deceleration exceeds a deceleration threshold value and/or exceeds a jerk threshold value, the cylinder performance module 206 may determine the strength of a particular cylinder is weak. In this regard, the cylinder performance module 206 may output a cylinder performance signal 254 indicating the existence of one or more weak cylinders 110*a*, 110*b*, etc. According to an embodiment, a strong cylinder may generate a first combustion force and a weak cylinder may generate a second combustion force that is less than the first combustion force.

The fuel calculation module 208 is in electrical communication with the cylinder performance module 206. The fuel calculation module 208 also receives a fuel scheduling signal 256 from the ECM 200, which indicates the amount of fuel delivered to each cylinder 110*a*, 110*b*, etc. during an each engine cycle. Based on the cylinder performance signal 254 and fuel scheduling signal 256, the fuel calculation module 208 may output a fuel amount signal 258 that indicates the amount of fuel delivered to one or more weak cylinders.

The fuel-to-torque conversion module 210 is in electrical communication with the fuel calculation module 208. Accordingly, the fuel-to-torque conversion module 210 is configured to convert the fuel amount signal 258 into a torque value, and generate a torque loss signal 260 indicating an amount of torque loss caused by one or more weak cylinders. The relationship between the EOS signal 252 generated during a particular engine cycle, the fuel provided to a weak cylinder and/or the torque loss may be modeled by an equation and/or may be stored as a lookup table as understood by one of ordinary skill in the art.

The torque correction module 212 is in electrical communication with the torque balancing module 204 and the fuel-to-torque conversation module 210. The torque correction module 212 receives the estimated torque signal 250 from the torque balancing module 204 and the torque loss signal 260 from the fuel-to-torque conversation module 210. According to an embodiment, the torque correction module 212 subtracts the torque loss from the estimated torque to determine a corrected torque value, and outputs a corrected torque signal 262 indicating the corrected torque value to the torque balancing module 204. In this manner, a closed feedback loop is formed such that the torque balancing module 204 determines a corrected torque value that compensates for one or more weak cylinders. The torque balancing module 204 may then dynamically adjust the estimated torque output over one or more engine cycles according to the corrected torque signal 262 and outputs an adjusted torque signal 264 to the ECM 200. The adjusted torque signal 264 may then be used by the ECM 200 to determine the respective EOS threshold value from the EOS LUT, which in turn is used to determine an engine misfire as described in detail above.

Figure 3:
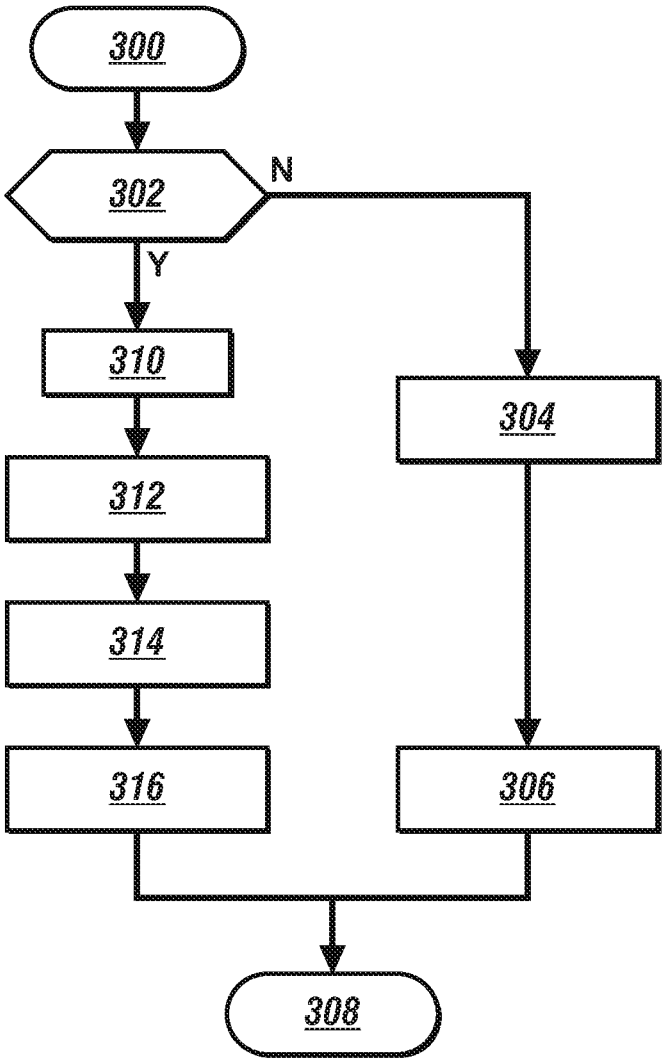
FIG. 3 is a flow diagram illustrating a method of compensating vehicle torque output according to an embodiment of the present disclosure.

Turning now to FIG. 3, a flow diagram illustrates a method of compensating vehicle torque output according to an embodiment of the present disclosure. The method begins at operation 300, and proceeds to operation 302 where a strength of one or more cylinders is determined. A strong cylinder may generate a first combustion force and a weak cylinder may generate a second combustion force that is less than the first combustion force. According to an embodiment, the strength of a cylinder may be based on, for example, a disturbance of an EOS signal that models the rotation of a toothed gear coupled to a rotating crankshaft. If, for example, the disturbance is below a threshold value, a corresponding cylinder is determined to be strong at operation 304. Proceeding to operation 306, an initial estimated torque output of the engine is maintained, and the method ends at operation 308. Accordingly, a misfire detection based on the initial estimated torque output is performed.

If, however, the disturbance exceeds the threshold value at operation 302, the corresponding cylinder is determined to be weak at operation 310 and the method proceeds to operation 312 where an amount of fuel delivered to the weak cylinder is determined. At operation 314, the determined amount of fuel delivered to the weak cylinder is converted into a torque value that indicates an amount of torque loss caused by the weak cylinder. The relationship between the EOS signal generated during a particular engine cycle, the amount of fuel provided to the weak cylinder and/or the torque loss may be modeled by an equation and/or may be stored as a lookup table as understood by one of ordinary skill in the art. At operation 316, the initial estimated torque output is adjusted based on the torque loss. According to an embodiment, the torque loss is subtracted from the initial estimated torque, for example, to determine the adjusted torque output. Upon determining the adjusted torque output, the method ends at operation 308. Accordingly, a misfire detection based on the adjusted torque output may be performed. In this manner, a weak performing cylinder caused by may be taken into account when performing the misfire detection such that the accuracy of the overall misfire detection is improved.

As used herein, the term "module" refers to a hardware module including an Application Specific Integrated Circuit (ASIC), an electronic circuit, a processor (shared, dedicated, or group) and memory that execute one or more software or firmware programs, a combinational logic circuit, and/or other suitable components that provide the described functionality.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A control system configured to control an internal combustion engine, comprising:

a crankshaft that is rotated in response to combusting a mixture of air and fuel delivered to at least one cylinder included in the internal combustion engine;

an engine speed sensor configured to output an engine output speed signal indicating a rotational speed of the crankshaft;

an engine control module configured control an amount of air and fuel delivered to the at least one cylinder and to estimate a torque output of the internal combustion engine based on the amount of air and fuel; and a torque compensation module in electrical communication with the engine control module and the engine speed sensor, the torque compensation module configured to determine at least one weak cylinder based on an engine output speed signal, and to determine a torque compensation value that adjusts the estimated torque output based on the at least one weak cylinder, the torque compensation value based on an amount of fuel loss resulting from a misfire of the at least one weak cylinder.

2. The control system of claim 1, wherein the compensation value is an amount of torque loss generated by the at least one weak cylinder, the amount of torque loss based on an amount of fuel delivered to the at least one weak cylinder.

3. The control system of claim 2, wherein the torque compensation module determines an adjusted torque output based on the estimated torque output and the amount of torque loss.

4. The control system of claim 3, wherein the engine control module determines the misfire of the at least one cylinder based the adjusted torque output.

5. The control system of claim 4, wherein the adjusted torque output is a difference between the estimated torque output and the amount of torque loss.

6. The control system of claim 5, wherein the torque compensation module is configured to dynamically adjust the estimated torque output based on the amount of torque loss over a series of engine cycles.

7. The control system of claim 6, wherein the misfire is determined based on a lookup table that cross-references at least one stored torque value with a respective engine output speed threshold value.

8. The control system of claim 7, wherein control module compares the adjusted torque output to the at least one stored torque value listed in the lookup table to determine the respective engine output speed threshold value, and determines the misfire based on a comparison between the engine output speed signal and the determined respective engine output speed threshold value.

9. An electronic control module configured to adjust an estimated torque output value to compensate for a misfire of at least one cylinder included in an internal combustion engine, the electron control module comprising:

a cylinder performance module configured to determine a strong cylinder based on a first combustion force and a weak cylinder based on a second combustion force that is less than the first combustion force;

a fuel calculation module in electrical communication with the cylinder performance module, the fuel calculation module configured to determine an amount of fuel delivered to the at least one weak cylinder;

a fuel-to-torque conversion module in electrical communication with the fuel calculation module, the fuel-to-torque conversion module configured to convert the fuel delivered to the at least one weak cylinder into a torque loss value; and a torque correction module in electrical communication with the fuel-to-torque conversion module, the torque correction module configured to generate an adjusted torque output value based on a difference between the estimated torque output value and the torque loss value.

10. The electronic control module of claim 9, wherein the cylinder performance module receives an engine output speed signal indicating a rotational speed of a crankshaft driven by the output of the at least one cylinder and determines the at least one weak cylinder based on a disturbance of the crankshaft.

11. The electronic control module of claim 10, wherein cylinder performance module detects the at least one weak cylinder in response to the disturbance exceeding a threshold value.

12. The electronic control module of claim 11, wherein the disturbance includes at least one of an acceleration, a deceleration, and a jerk.

13. The electronic control module of claim 12, wherein the acceleration and deceleration is based on a first derivative of the rotational speed, and the jerk is based on a second derivative of the rotational speed.

14. A method of controlling an internal combustion engine, the method comprising:

combusting a mixture of air and fuel delivered to at least one cylinder included in the internal combustion engine to rotatably drive a crankshaft;

generating an engine output speed signal indicating a rotational speed of the crankshaft;

estimating a torque output of the internal combustion engine based on the amount of air and fuel delivered to the at least one cylinder;

determining at least one weak cylinder based on the engine output speed signal; and determining a torque compensation value based on an amount of fuel loss resulting from a misfire of the at least one weak cylinder; and adjusting the estimated torque output based on the torque compensation value.

15. The method of claim 14, wherein the compensation value is an amount of torque loss generated by the at least one weak cylinder.

16. The method of claim 15, wherein the determining a torque compensation value further comprises determining an adjusted torque output based on the estimated torque output and the amount of torque loss.

17. The method of claim 16, further comprising determining a misfire of the at least one cylinder based the adjusted torque output, the adjusted torque determined as a difference between the estimated torque output and the amount of torque loss.

18. The method of claim 17, further comprising dynamically adjusting the estimated torque output based on the amount of torque loss over a series of engine cycles.

19. The method of claim 18, wherein the misfire is determined based on a lookup table that cross-references at least one stored torque value with a respective engine output speed threshold value.

20. The method of claim 19, further comprising comparing the adjusted torque output to the at least one stored torque value listed in the lookup table to determine the respective engine output speed threshold value, and determining the misfire based on a comparison between the engine output speed signal and the determined respective engine output speed threshold value.

* * * * *